US007422257B2

(12) United States Patent
Neufeldt

(10) Patent No.: US 7,422,257 B2
(45) Date of Patent: Sep. 9, 2008

(54) TRUSS GRIPPING HOOK

(76) Inventor: Roy E. Neufeldt, 1407 Spring Creek Ave. S., Red Wing, MN (US) 55066

( * ) Notice: Subject to any disclaimer, the term of this patent is extended or adjusted under 35 U.S.C. 154(b) by 0 days.

(21) Appl. No.: 11/440,526

(22) Filed: May 25, 2006

(65) Prior Publication Data

US 2006/0208514 A1 Sep. 21, 2006

Related U.S. Application Data

(63) Continuation of application No. 10/299,358, filed on Nov. 18, 2002, now Pat. No. 7,059,644.

(51) Int. Cl.
*B66C 1/36* (2006.01)

(52) U.S. Cl. ..... 294/82.24; 294/101

(58) Field of Classification Search ..... 294/86.24, 294/82.36, 101, 82.19, 102.1, 82.13
See application file for complete search history.

(56) References Cited

U.S. PATENT DOCUMENTS

| | | | | | |
|---|---|---|---|---|---|
| 1,576,197 | A | | 3/1926 | Kuffel et al. | 294/82.19 |
| 1,638,678 | A | | 8/1927 | Bond | 294/82.23 |
| 2,357,054 | A | | 8/1944 | Muddiman | 294/83 |
| 2,445,106 | A | | 7/1948 | Dempster | 294/83 |
| 2,618,504 | A | | 11/1952 | Penn | 294/104 |
| 3,071,406 | A | | 1/1963 | Lucker, Jr. | 294/104 |
| 3,167,343 | A | | 1/1965 | Renfroe | 294/67 |
| 3,186,055 | A | | 6/1965 | Modrey | 24/241 |
| 3,189,377 | A | | 6/1965 | Gardner | 294/101 |
| 3,224,803 | A | | 12/1965 | Elsner et al. | 294/83 |
| 3,336,068 | A | | 8/1967 | Renfroe | 294/101 |
| 3,356,406 | A | | 12/1967 | Renfroe | 294/101 |
| 3,370,881 | A | | 2/1968 | Renfroe | 294/101 |
| 3,441,308 | A | * | 4/1969 | Gardner | 294/101 |
| 3,659,890 | A | | 5/1972 | Renfroe | 294/104 |
| 3,851,358 | A | | 12/1974 | Janosko | 24/248 C |
| 3,871,698 | A | | 3/1975 | Fontana | 294/82.33 |
| 3,918,758 | A | * | 11/1975 | Fournier | 294/82.36 |
| 4,037,869 | A | | 7/1977 | Terada et al. | 294/104 |
| 4,113,298 | A | | 9/1978 | Kopp | 294/104 |
| 4,165,114 | A | | 8/1979 | Nutter | 294/19 R |
| 4,327,944 | A | | 5/1982 | Langloy | 294/101 |
| 4,379,579 | A | * | 4/1983 | Mahan et al. | 294/82.36 |

(Continued)

FOREIGN PATENT DOCUMENTS

| | | | | |
|---|---|---|---|---|
| SU | 1084227 | A | 4/1984 | 294/92.24 |

*Primary Examiner*—Saul J. Rodriguez
*Assistant Examiner*—Paul T. Chin
(74) *Attorney, Agent, or Firm*—Nawrocki, Rooney & Silvertson, P.A.

(57) ABSTRACT

Cable supported hook apparatus provides a U-shaped upward facing opening for transporting a truss. A cam pivotably mounted opposite the opening has a serrated edge opposite a handle. A slot in the opening permits a spring to urge the cam from a released orientation to an engaged orientation with the serrated edge extending through the slot. In the released orientation, a knob retractable spring driven pin extension can extend through a hole in the cam and secure it in place. In use, the handle is first used to rotate the cam to the released and secured orientation. After engagement with the truss, the extension is retracted by the knob which permits the cam to engage the truss. After transportation a release cable rotates the cam to the released and secured orientation to free the truss.

6 Claims, 7 Drawing Sheets

U.S. PATENT DOCUMENTS

| | | | | |
|---|---|---|---|---|
| 4,427,228 | A | 1/1984 | Mattila | 294/83 R |
| 4,489,970 | A | 12/1984 | Henke | 294/67.22 |
| 4,492,401 | A | 1/1985 | Renfroe et al. | 294/101 |
| 4,572,563 | A | 2/1986 | Fontana | 294/82.24 |
| 4,609,219 | A | 9/1986 | Go | 294/82.24 |
| 4,834,760 | A * | 5/1989 | Richter, Jr. | 294/19.1 |
| 4,977,647 | A | 12/1990 | Casebolt | 24/599.5 |
| 5,271,128 | A | 12/1993 | Storm | 24/601.5 |

* cited by examiner

TRUSS GRIPPING HOOK

This is a continuation application under 37 CFR §1.53(b) of application Ser. No. 10/299,358 filed on Nov. 18, 2002 for an invention entitled TRUSS HOOK, which issued as U.S. Pat. No. 7,059,644 on Jun. 13, 2006.

FIELD OF THE INVENTION

This invention relates to hook apparatus used at a construction site for gripping a truss member during transportation to its final location on a building, and then remotely releasing the truss.

BACKGROUND OF THE INVENTION

A variety of hooks are available to engage and transport various items. The majority of hooks utilize a downwardly or horizontally directed opening which mount a pivotable cam to engage the transported item and secure it in place. While most hooks are arranged to engage and disengage the hook from the transported item, none are arranged to disengage the hook remotely. Since this hook is intended to be used to transport a truss to its final location on a building, the truss will always be transported to an elevated location. Removing a hook from a truss in an elevated location poses the safety hazzard of falling to the worker. It would be advantageous if the hook could be released from a lower remote location to eliminate this hazard.

SUMMARY OF THE INVENTION

The problem addressed relates to hooks used to engage, secure and transport roof trusses during construction, and to release the hook when the truss is in its final elevated location. Currently hooks used in construction to elevate a truss to its final location in a structure must be disengaged by hand. Since a truss by its very nature is always installed at the highest point on a building, this manual removal presents a considerable risk of falling.

This hook has an upwardly directed U-shaped opening for holding and supporting the truss. A spring driven cam, extending through a slot into the opening, grips the truss during transport. A release cable, operable from a safe location at a lower level, is manually operated to pull against the cam spring and rotate the cam outward from the opening to release the truss from the cam. In this released position a spring driven extension from a pin in the apparatus can pass through a hole in the cam to secure it in the rotated orientation where the truss is free. The cam has a handle which permits rotating the cam to the released position manually to permit initially enclosing the truss. The pin has a knob to pull the spring driven extension outward from the cam hole to release the cam. This is used after the truss is initially enclosed to permit the cam spring to drive the cam against the truss and secure the truss for transport.

While the figures illustrate the use of two hooks for transporting the truss, it is possible to use a single hook for transporting a small truss. In a considerable number of operations however, the truss is large enough to require the use of a pair of hooks for transport. Since this later operation is more complex this is the one described, however the operation for a single hook is similar.

First the cam for one hook is rotated outwardly using the handle extension, until the spring driven extension from the pin is aligned with the hole through the cam, which then secures the cam in this orientation outside the U-shaped openings. The hook, attached to lifting cables with its U-shaped openings facing upward, is then positioned under one end of a truss such that the U-shaped opening envelopes an inclined upper board of the truss. The spring driven pin extension is then pulled outward manually, to permits the cam spring to force the cam against the truss to grip and secure the truss in place. This process is repeated on the opposite end of the truss for the other hook.

The truss is then elevated into its final location on the building using the suspension cables. When the truss is in its final location, the release cables for both hooks are then pulled manually until the cams are rotated free of the truss and again engaged by their respective spring driven extensions from the pins. This secures the cams in an orientation outside of their respective U-shaped opening and frees the hooks from the truss. The freed hooks are then simply lowered from the truss to release them, and the process repeated for the next truss. When only a single hook is used, it is manipulated in the same manner as the pair of hooks described above, only the attachment point to the truss is changed, since when only a single hook is used the point of attachment of the hook must be at or near the center of balance of the truss.

Since a release cable can be made any desirable length, it can even be extended down to the ground to provide maximum worker safety. In a second embodiment, the U-shaped opening of the hook can be made adjustable in width. This permits using the hook with the different width truss cross-sections normally used in construction. Without this alternative hooks would have to be provided which have various widths corresponding to the various truss widths.

As indicated above, the truss hooks are used in pairs for a large truss with the hooks supporting the opposite ends of the truss. The hook pairs can be separated by a spreader bar which has the proper length for the truss being raised. The hooks grip the uppermost inclined boards of the truss. The lower connecting portion of the hook's U-shaped opening can have an upwardly directed V-shaped cross-section to accommodate this inclination, which will result in the inclined upper truss boards always bearing directly against one of the V-shape sides. A number of pointed rods can be mounted through each side of the V-shaped edge with their points extending outward perpendicular to the sides. These pointed rods would engage the wood of the boards to prevent the truss from translating with respect to the hook during transit.

The follow descriptions relating to the drawings, including left, right, up and down, refer to the relative positions of elements as shown on the above drawings in order to facilitate the detailed description of the invention.

DETAILED DESCRIPTION OF THE INVENTION

Figure 1:
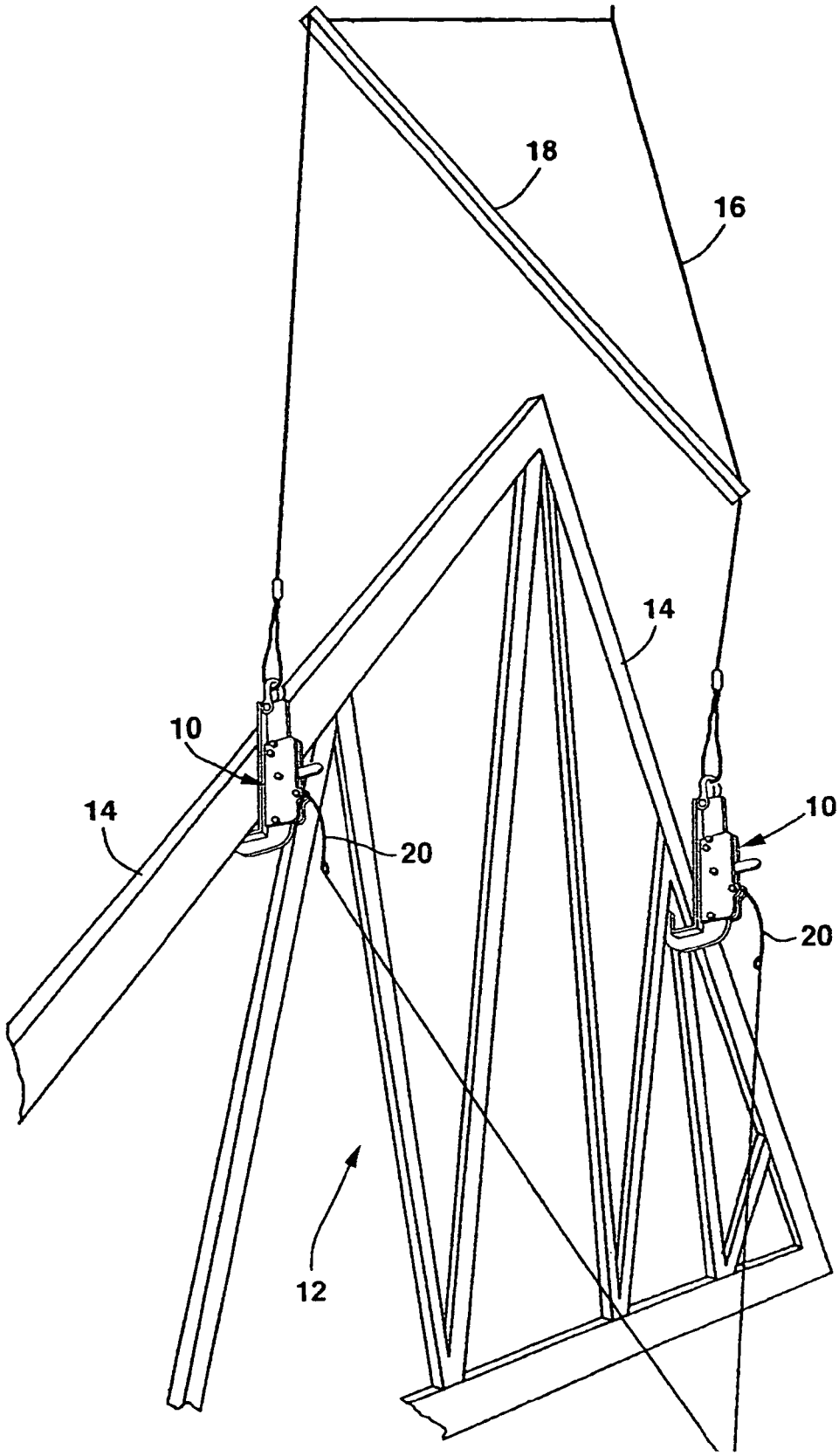
FIG. 1 shows a pair of truss hooks supporting a truss.
Figure 2:
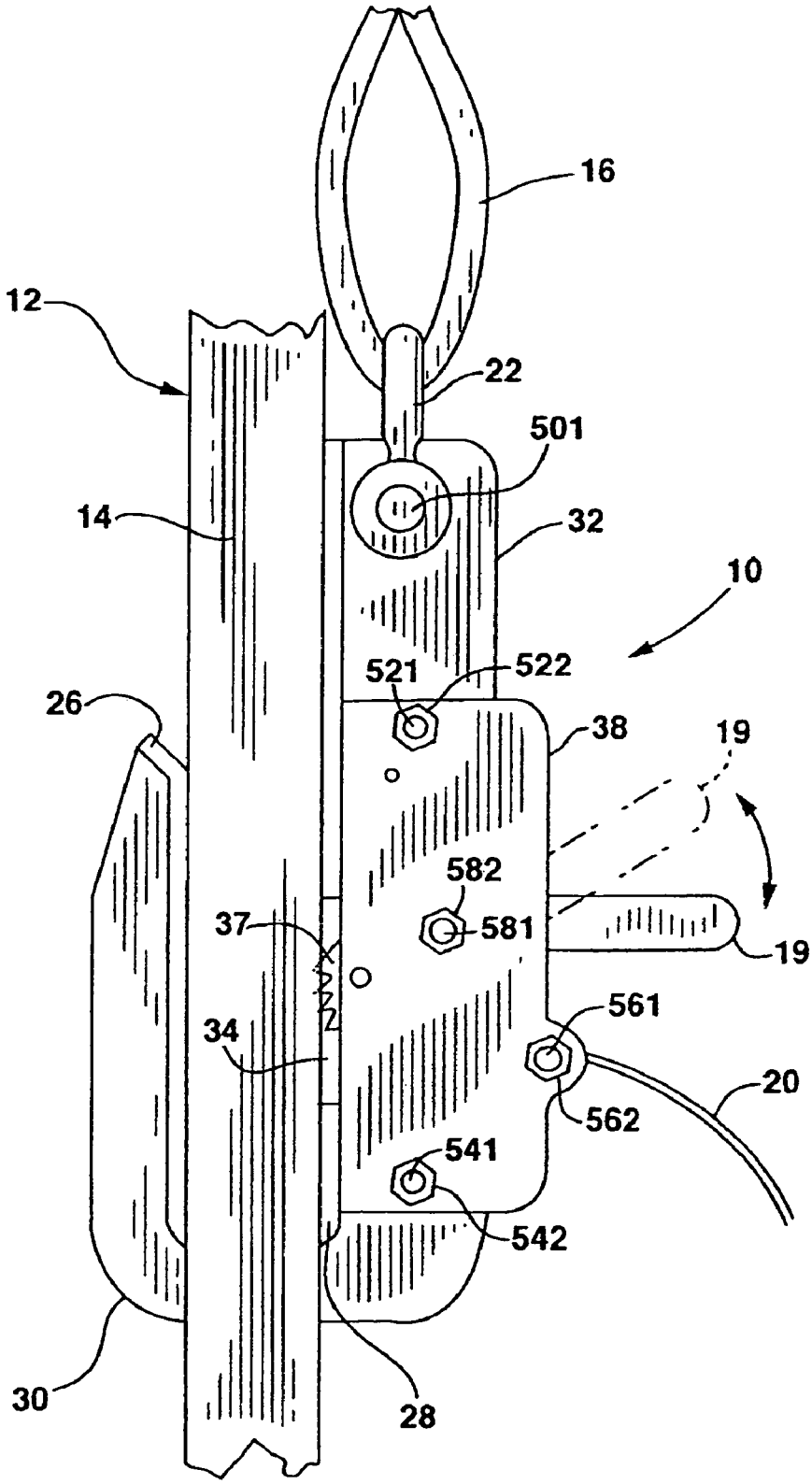
FIG. 2 shows a side view of an assembled fixed opening truss hook.
Figure 3:
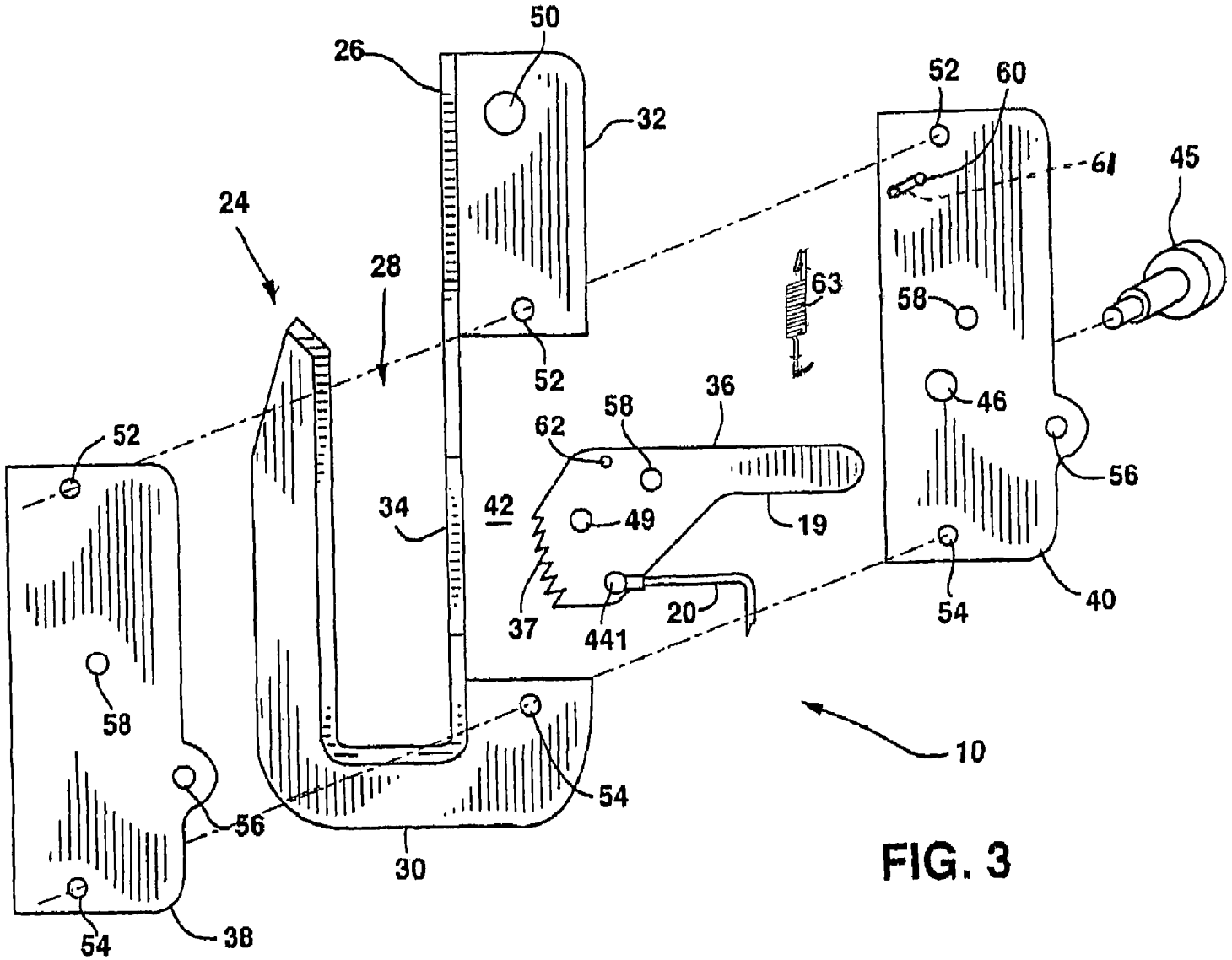
FIG. 3 shows an exploded view of the major parts of a fixed opening truss hook.

FIGS. 1, 2 and 3 illustrate truss hook 10. A pair of hooks 10 are shown supporting truss 12 by its opposed inclined upper boards 14. Each hook 10 is supported by a suspension cable 16 having a spreader bar 18 which spaces the hooks the proper distance apart.

An essentially planar and rectangular steel strap 26 is bent to form U-shaped opening 28 such as to provide a hook structure 24. Lower reinforcement 30 and upper reinforcement 32, shaped to conform to the outer shape of bent strap 26, are both welded perpendicular along the strap center. A gap 42 is provided between lower reinforcement 30 and upper reinforcement 32. A slot 34 is provided through strap 26 which is centered along the length of strap 26 opposite gap 42. Slot 34 provides an opening sized to permit the serrated edge 37 of cam 36 to extend into U-shaped opening 28. Top plate 38 and bottom plate 40, located on opposite sides of lower reinforcement 30 and upper reinforcement 32 are spaced apart by these reinforcements and cover gap 42. The spacing between plates 38 and 40 permit cam 36 to pivot between them.

A nut 522 secures bolt 521 through aligned mating holes 52 in top plate 38, in upper reinforcement 32 and in bottom plate 40, attaches the upper end of the plates on opposite sides of the upper reinforcement. A nut 542 secures bolt 541 through aligned mating holes 54 in top plate 38, lower reinforcement 30 and bottom plate 40, attaches the lower end of the plates on opposite sides of lower reinforcement 30. A bolt 561 is secured by a nut 562 extends through holes 56 in top plate 38 and bottom plate 40. Bolt 561 provides support for cable 20 and provides a downward direction where the cable exits from the hook, its purpose being described further later.

Cam 36 has opposed extensions, handle 19 which extends outward in one direction, and serrated edge 37 which extends outward in the opposite direction. Holes 58 in top plate 38, in cam 58, and in bottom plate 40 are provided. Nut 582 secures bolt 581 extending upward through holes 58 to rotatably secure cam 36 between top plate 38 and bottom plate 40. Bolt 581 provides pivotal support for cam 36. Cam 36 can rotate around bolt 581 such that handle 18 can be positioned between the locations as shown in solid and in dashed outline in FIG. 2, which will result respectively in serrated edge 37 extending within opening 28 to grip a truss located within the opening, or withdrawing from the opening to release the truss.

Suspension cable 16 engages shackle 22, which is attached to hook 10 through hole 50 by a bolt 501 extending downward through the shackle engaged by a nut, not shown. Suspension cable 16 suspends hook 10 such that U-shaped opening 28 opens upward.

One end of release cable 20 is attached to cam 36 by means of a bolt 441 and a mating nut, not shown, through a mating hole 44 in cam 16, not shown. Cable 20 extends over bolt 561 secured by a nut, not shown, which extends through aligned holes 56 through top plate 38 and bottom plate 20. The operation of release cable 20 will be described further later.

Pin 45, which has a spring driven extension from one end and a retracting knob on the opposite end, is mounted and retained within hole 46 in bottom plate 40 using an interference fit. Pulling on the knob of pin 45 against the spring will retract the extension within the body of the pin. When extended the extension of pin 45 can extend into a locking hole 49 in cam 36, but only when cam 36 is rotated counter-clockwise to the orientation shown in the dashed outline in FIG. 2, where the serrated edge 37 of cam 36 is withdrawn from U-shaped opening 28. Since the extension from pin 45 is spring driven, whenever locking hole 49 in cam 36 is rotated to a position opposite pin 47, the extension will be forced by its spring into the locking hole.

A pin 61, not shown in these figures, is mounted in hole 60 in bottom plate 40 and extends outward to abut top plate 38. A spring 63, is secured by pin 61 on one end and is secured on the opposite end by spring hole 62 in cam 36. With this arrangement, spring 63 will urge cam 36 clockwise. A clockwise rotation will urge serrated edge 37 of cam 36 through slot 34 into U-shaped opening 28. With this arrangement, serrated edge 37 of cam 36 will always be urged through slot 34 into U-shaped opening 28 by spring 63 unless the cam is held in the counter-clockwise orientation by the spring driven extension from pin 45 extending through hole 49. The location of spring 63, which is identical in location and operation in hook 10 and in hook 11, is described further as part of a following hook 11 description.

Release cable 20 is attached through a hole 44, not shown, by a bolt 441 extending through an eyelet attached to the end of the cable and hole 44 which is secured by a matching nut.

Hook 10 has a fixed U-shaped opening 28. Trusses come in several widths, depending upon the number of stacked boards making up an individual truss. As mentioned above, in construction where a variety of truss widths are used, individual truss hooks 10 providing the required different width openings can be provided. In some circumstances, it may be more useful if the width of the hook opening could be changed on site to match the different truss widths with only one type of hook required.

Figure 4:
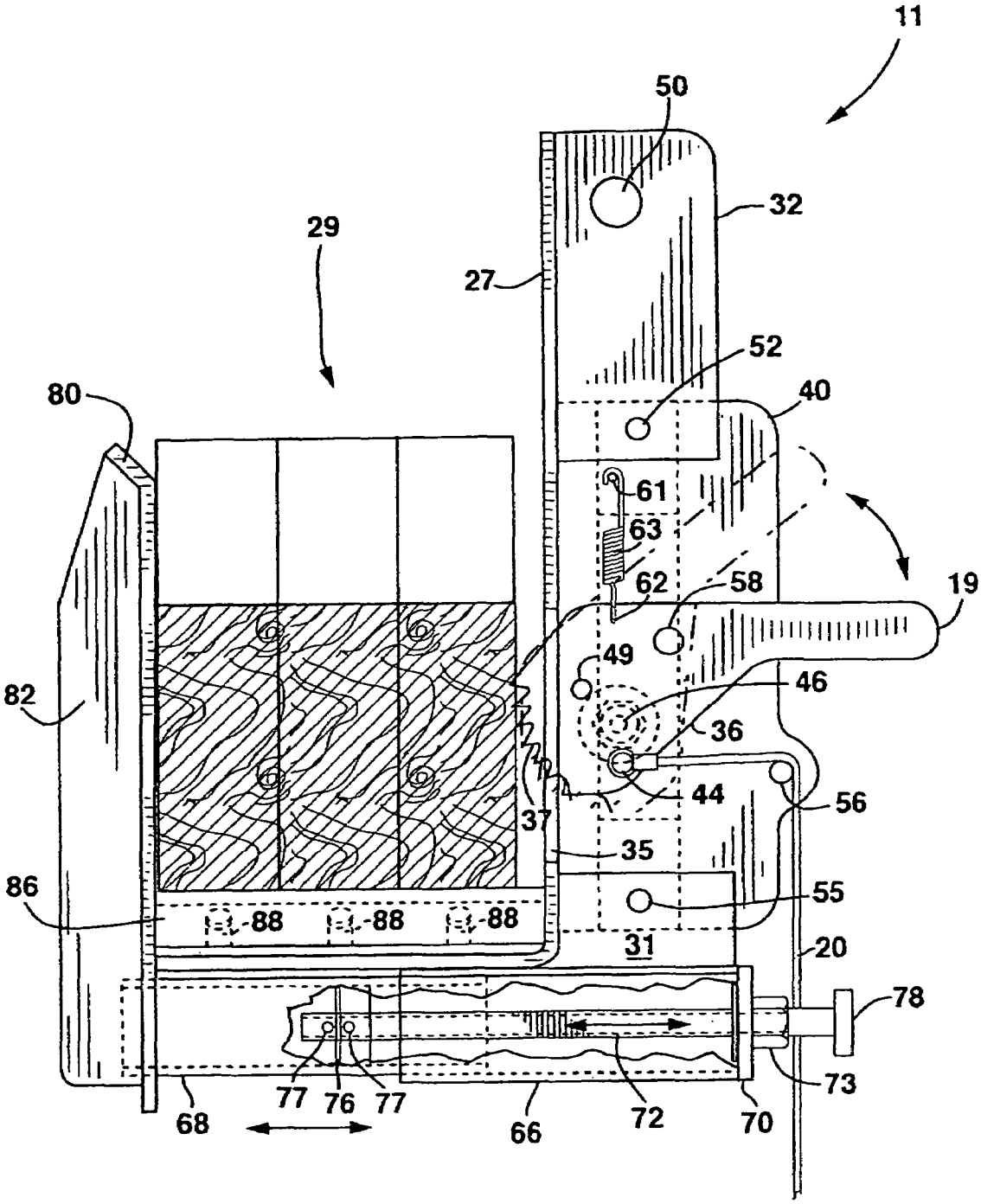
FIG. 4 shows a side view of an assembled truss hook which has an adjustable width opening, adjusted to maximum width, with some parts being removed and with a cut-out provided to aid in description.
Figure 5:
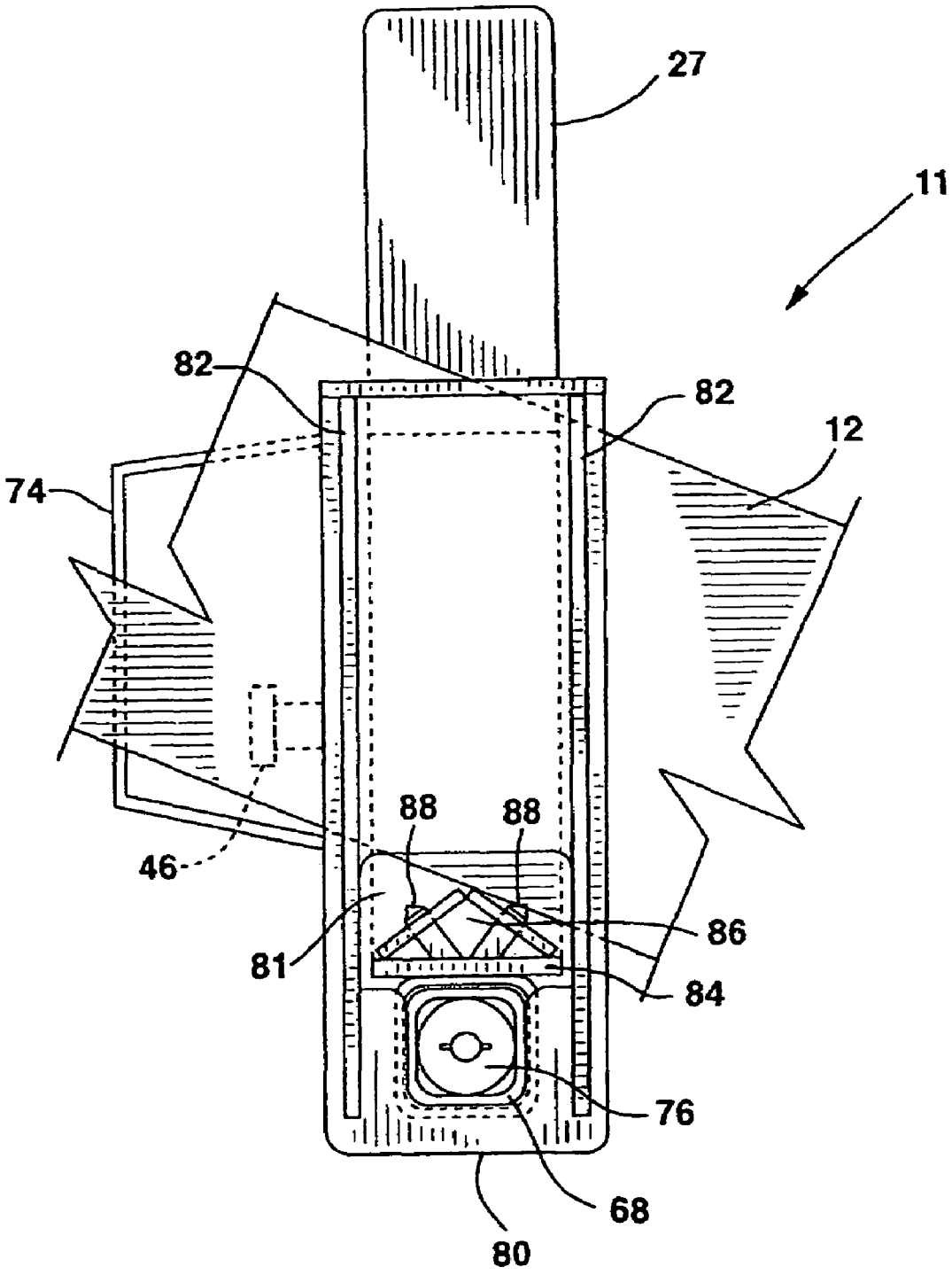
FIG. 5 shows a cross-section view of a truss hook with a adjustable width opening supporting a truss.
Figure 6:
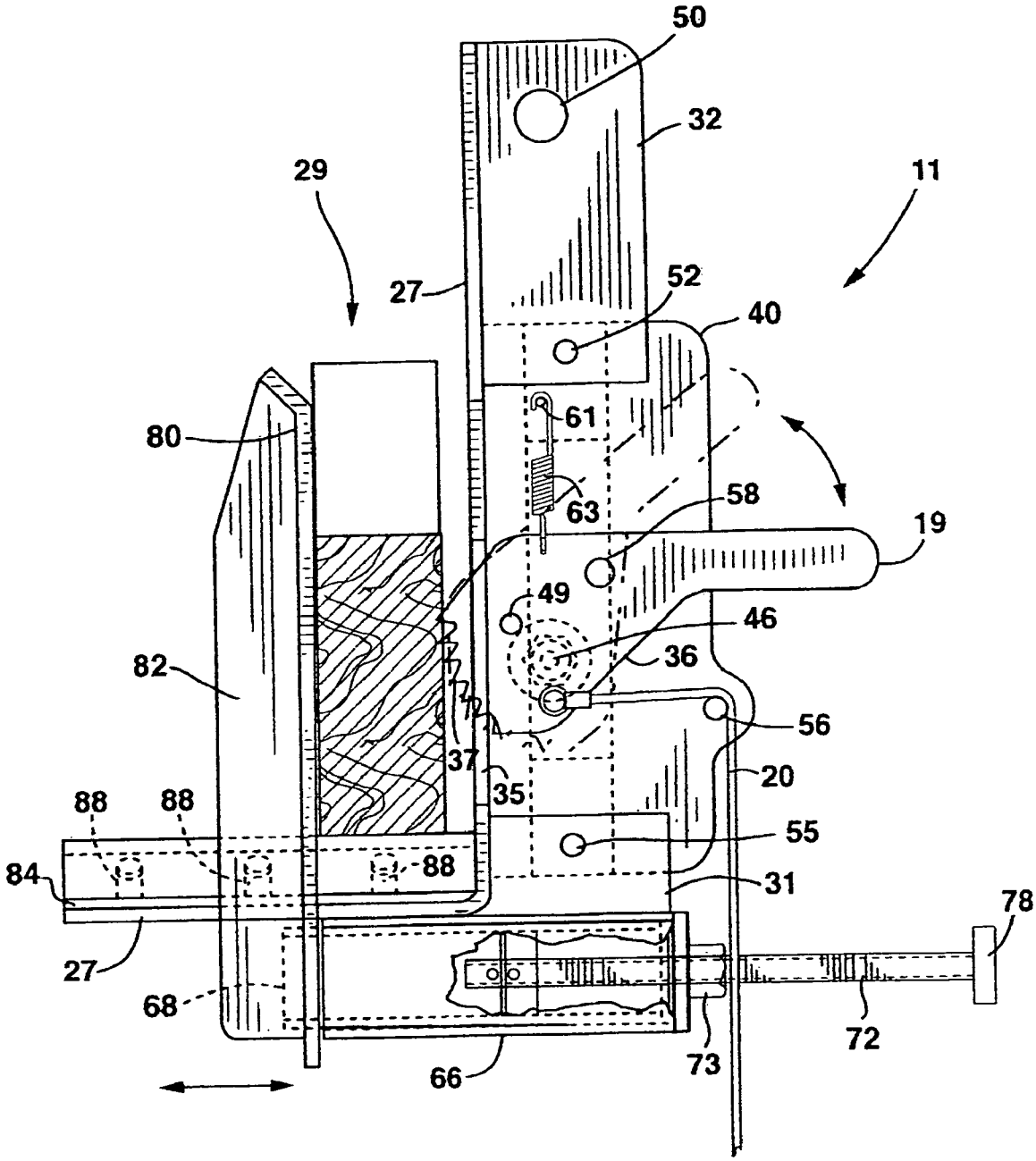
FIG. 6 is the same as side view of FIG. 4 excepting that the opening is adjusted to minimum width.
Figure 7:
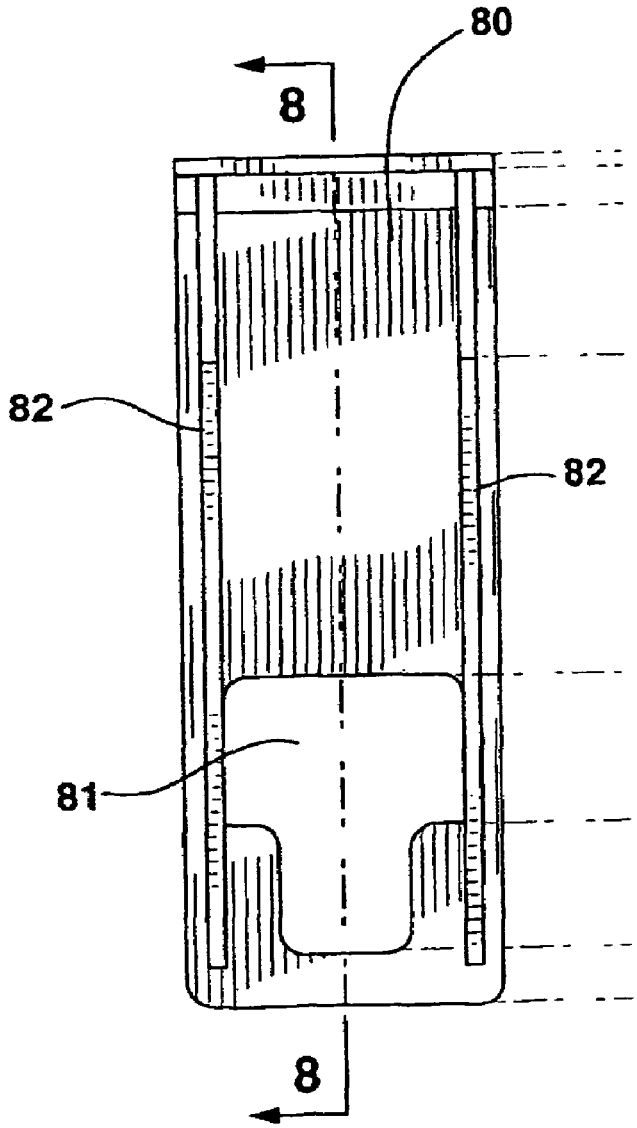
FIG. 7 is a side view of FIG. 4 looking inward toward the movable part of the U-shaped opening and FIG. 8 is cross-section 8-8 of FIG. 7.
Figure 8:
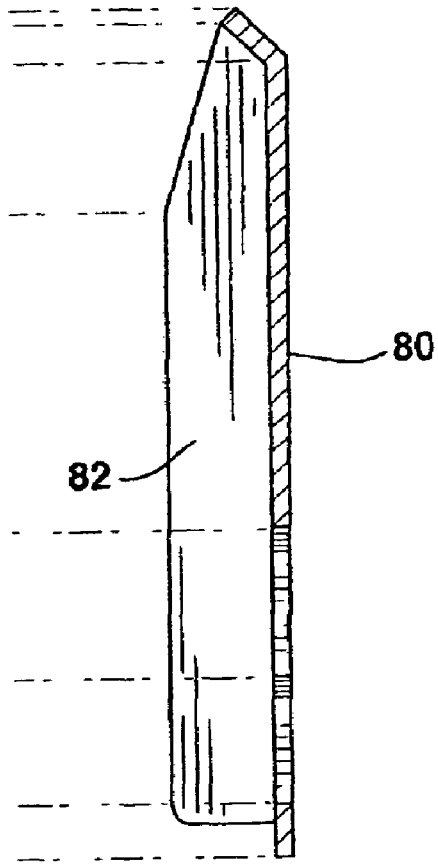

Hook 11, illustrated in the FIGS. 4, 5, 6, 7 and 8, has a U-shaped opening 29 which can readily be varied in width on site. The parts, their operation and their locations for hook 11, which are not related to the width adjustment of U-shaped opening 29, are the same for hook 11 as for hook 10 and operate in the same manner. Consequently, the following description of the construction and operation of hook 11, excepting those parts related to the change of the width of U-shaped opening 29, utilize the same parts with the same operation and locations. Consequently, the following discussion of hook 11 also provides a further description of the operation of hook 10. In particular, FIG. 6 shows hook 11 with spring 63 in place. Spring 63 in hook 11 has the same location, is attached in the same way, and provides the same function here as for hook 10.

Hook 11 has only one of the opposed sides and the lower connecting portion of U-shaped opening 29 provided by strap 27. This is unlike hook 10 which has both of the opposed sides and the lower connection portion of U-shaped opening 28 provided by strap 26. The opposite side of U-shaped opening 29 of hook 11 has a movable jaw which can be moved to provide a variable width opening. Strap 27 is also made wider than strap 26 to accommodate the variable width apparatus.

Upper reinforcement 32, identical to the part used in hook 10, is welded centered and perpendicular to strap 27 with a shackle hole 50 and a connecting hole 52. Here lower reinforcement 31, is dissimilar to lower reinforcement 30 in that it only extends along the right side of strap 27. Lower reinforcement 31 is also welded centered and perpendicular to the strap, with the same size gap provided between lower reinforcement 31 and the upper reinforcement 32 as in gap 42 for hook 10. A centered vertical slot 35 through strap 27, the same size as slot 34 through strap 26, again provides access for the serrated edge 37 of cam 36. Hole 52 is again provided for nuts and bolts, not shown, to attach top plate 38 and bottom plate 40 on opposite sides of upper reinforcement 32 such as to cover the gap between them. Top plate 38 and bottom plate 40 for hook 11 are identical to those for hook 10.

Lower reinforcement 31, top plate 38 and bottom plate 40 all have a hole 55 arranged to attach the lower end of bottom plate 40 and top plate on opposite sides of the lower reinforcement using a bolt and nut, not shown.

Pin 45, which has a spring driven extension and a retracting knob, is again attached extending upwardly by an interference fit through hole 48 in bottom plate 40. As described earlier, the working parts, other than those related to changing the width of U-shaped opening 29 are the same in hook 11 as in hook 10. Therefore all of the holes provided for top plate 38, bottom plate 40, cam 36, cable 20, pin 45, extension 48 and spring 63 are in the same location with the same bolts and nuts provided for hook 11 as for hook 10. This illustration of the attachment of spring 63 to hook 11 is identical to its attachment in hook 10, and thus also illustrates the attachment of the spring for hook 10.

An optional guard 74, formed from a metal strap wider than the knob of pin 45, is attached between upper reinforcement 50 and lower reinforcement 31 to protect the pin from damage. If desired, a similar guard arrangement could also be provided for hook 10.

The essential difference between hook 11 and hook 10 is the ability of hook 11 to adjust the width of U-shaped opening 29. The adjustment apparatus consists of the apparatus located on the lower and left side of U-shaped opening 29.

The lower portion includes the leftward extension of strap 27, and a hollow outer sleeve 66 which has a rectangular shaped cross-section. Outer sleeve 66 is welded across the bottom of the leftward extending portion of strap 27. Outer sleeve 66 slideably encloses hollow inner sleeve 68 which has a mating rectangular shaped cross-section. Cap 70, welded to the right end of outer sleeve 66 has a centered hole sized to admit threaded rod 72. Washer 76 encloses the left end of rod 72. The outer portion of washer 76, which abuts inner sleeve 68 at four points at the four sides of inner sleeve 68, is welded to the sleeve at those four points. Pins 77, located on opposite sides of washer 76, extend perpendicularly through mating holes in rod 72 with an interference fit, such that one of the pins will engage the washer whether rod 72 is translated to the right or to the left. Nut 73, welded to the outside of cap 70 mates with rod 72. A knob 78 is attached o the end of rod 72. With this arrangement, when knob 78 is rotated rod 72 will translate within nut 73. This translation of rod 72, acting through pins 77, will also translate washer 76 and attached inner sleeve 68.

Base 84 is welded across the top of the leftward extending portion of strap 27. Base 85 is formed by a rectangular shaped planar strap. Inverted V-shaped enclosure 86, formed by bending another rectangular shaped strap along its length, matches base 84 along its open side which is welded along the top of the base. A number of spaced apart pointed rods 88 are welded to and extend a small distance outward through mating holes on both sides of the length of inverted V-shaped enclosure 86. Pointed rods 88, being inclined by the inverted "V" shape of enclosure 86, will better engage the inclined upper board of truss 12 located within U-shaped opening 29 to prevent the truss from translating with respect to the opening.

Vertical jaw reinforcements 82 are welded along opposite sides along the outside of jaw 80. Jaw 80, has a hole 81 with a large upper rectangular opening which interconnects a smaller rectangular shaped lower opening. The smaller lower rectangular opening encircles and is welded to the outer end of inner sleeve 68. The larger adjoining rectangular upper opening permits strap 27, outer sleeve 66 attached across the bottom of the strap, and attached base 84 and enclosure 86 attached across the top of the strap, to extend through jaw 68. With this arrangement when inner sleeve 68 is translated by rotating bolt 72, attached jaw plate 78 and its jaw reinforcements 82 will also be translated and either close or open U-shaped opening 29.

Truss 12 is shown in FIG. 5 engaging the rightmost side of V-shaped enclosure 86 and the pointed rods 88 on that side. Truss 12 is shown inclined because the portion of the truss which is engaged is the inclined uppermost board, as is shown in FIG. 1. With this arrangement the inclined uppermost board of truss 12 will always have the proper angle to engage either the right or the left side of enclosure 86 and its respective outward directed pointed rods 88.

When hook 11 is used, the width of the U-shaped opening 29 is first adjusted to correspond to the width of the particular truss 12 to be lifted, which depends upon the number of truss boards used. FIG. 6 illustrates a truss of one board and FIG. 4 illustrates a truss of three stacked boards. The adjustment is accomplished by rotating knob 78 attached to rod 72, which will translate outer jaw 80 and its attached parts, until the desired width U-shaped opening 29, corresponding to the width of the truss to be moved, is obtained. Note that when hook 10 is used, this step is replaced by selecting a hook with the required width.

The following operations, with the exception of the above changes for the width of hook 11 or the selection of a proper hook 10, are the same for either hook 10 or 11, therefore only the operation of hook 10 is described below. Two hooks are necessary to lift a both ends of a truss, therefore a hook 10 is provided for the two ends of the truss.

First, the serrated edges 37 of cams 36 are withdrawn from slots 34 and U-shaped openings 28 in hooks 10 by manually rotating the cams, using handles 18, until the serrated edges are moved outward from U-shaped openings 28, and until pins 45 are aligned with holes 49 to secure the cams at this location. Hooks 10 are then placed under opposite ends of the topmost board of the truss to be transported, as shown in FIG. 1 for truss 12, and pins 46 then pulled outward to permit springs 63 to release cams 36 which will then rotate clockwise and drive their serrated edges 37 against the truss. This secures a hook 10 around each end of truss 12. Truss 12 is then hoisted into its final position on the building. Downward extending cables 20 from each hook 10, resulting from the cables passing over bolts 56, are then used to rotate the cams 36 counter-clockwise against springs 63 which will move the serrated edges 37 of hooks 10 outward until they are withdrawn from their respective U-shaped openings 28 into slots 34, and until the extensions from pins 45 extend into holes 49 and secure the cams at this rotation where the truss 12 is freed. Hooks 10 are than simply lowered away from truss 12 and the above process repeated to place the next truss into position. Other similar arrangements could also be provided for adjusting the width of U-shaped opening 29, which would readily occur to those skilled in the art.

As discussed earlier, rather than providing apparatus to change the width of U-shaped opening 28, hook 10 could be made with different widths openings corresponding to the multiples of widths provided by different truss widths. Accommodating different width trusses would then become merely a matter of selecting a hook 10 having the proper width opening.

Using a cable to release the hook from a truss, which has been elevated to its final location on a building, greatly reduces the hazard inherent in the present construction operation. Presently a workman must climb up to the hook location, after the truss has been elevated to its location on a building, to release the hook. Since the truss is part of the roof structure, this is always the highest point on a building. Consequently, removing a hook at this location will always be hazardous. Since the cables used to release the hooks in this invention can be made any length, they can even reach down to the ground which will completely eliminate the hazard.

The arrangement for changing the width of the U-shaped opening 29 for hook 11, described above, namely using a rotating bolt 72 to change its width of U-shaped opening 29, is only one of a number of similar arrangements that could be used. As an example, rather than using a threaded rod 72 and interacting parts, these could be dispensed with, and pairs of opposed holes in both the outer sleeve 66 and the inner sleeve 68 provided. The pairs of holes in the sleeves would be spaced apart the same distance as the difference in truss widths, and arranged such that the holes in the inner sleeve 68 and the outer sleeve 66 would be aligned in sequence when the inner sleeve is moved the width of a single truss board within the outer sleeve. The opposed holes in the sleeves would become aligned at each different truss width. A pin with an extending spring loop at an end opposite a knob could be pushed through the aligned holes in the two sleeves to secure them together. The spring loop would retain the pin in place.

A modification in mounting the pointed tips used to prevent translation of the truss would be to rotate both the inner and outer sleeve forty five degrees such that one of the corners is innermost. This would eliminate the requirement for a base and enclosure to attach the pointed rods inclined outwardly and inwardly from each side, since the two upper surfaces of the outer sleeve would provide the required angle.

While this invention has been described with reference to illustrative embodiments, these descriptions are not intended to be construed in a limiting sense. Various modifications of these illustrative embodiments, as well as other embodiments of the invention, will be apparent to persons skilled in the art upon reference to these descriptions. It is therefore contemplated that the appended claims will cover any such modifications or embodiments as fall within the true scope of the invention.

What is claimed is:

1. Truss hook apparatus comprising:

a) a hook having an essentially U-shaped opening, the hook also having a slot through one of the sides of the opening oriented essentially perpendicular to both the opening and the side, the opening being sized to admit the cross-section of a truss;

b) the hook having a rotatably mounted cam, the cam being located within the opening and aligned therewith, the cam having an inner edge facing the slot, the cam being sized to permit the inner edge to rotate outwardly through the slot in a first position, and to extend into the opening an adequate amount to grip a truss located therewithin in a second position, the apparatus having a spring attached between the cam and one of the sides of the opening arranged to urge the cam from the first to the second position; and c) a release cable opposing said spring arranged to pivot said cam such as to withdraw the cam from the second to the first position and release a truss located within said hook opening;

d) an essentially planar strap bent into a U-shape with opposed essentially parallel first and second sides connected by an essentially perpendicular third side;

e) a first reinforcement being attached centered and perpendicular to the outside of the bent strap along the first side, the third side and an adjoining portion of the second side, the reinforcement being shaped to conform to the outer portions thereof;

f) a second reinforcement being attached centered and perpendicular to the outside of the bent strap extending inwardly from the outer end of the second side along a portion thereof, the second reinforcement being shaped to conform to the outer portion of the second side, and having a length such as to leave a gap between the first and the second reinforcement;

g) a centered slot through the strap along the second side opposite the gap between the first and the second reinforcement; and h) a first plate and a second plate attached on opposite sides of the first and the second reinforcement sized to cover the gap therebetween.

2. Apparatus as in claim 1 wherein said cam comprises:

a) the cam being essentially planar with the inner edge being serrated with an opposing handle, the cam being pivotably mounted between and essentially parallel to the sides of the U-shaped opening being further located, arranged and sized to result in the serrated edge of the cam extending through the slot into the U-shaped opening in a second position, and the serrated edge withdrawn from the opening in a first position, with the handle extending outward in a direction essentially opposite to the serrated edge; and b) a spring attached between the cam and one of the sides to urge the cam from the first position to the second position.

3. Apparatus as in claim 2 wherein said cable operated release means comprises a release cable having a first and a second end, the first end of the cable being attached to the cam with the second end of the cable extending outward from the hook in a direction generally opposite to said slot.

4. Apparatus as in claim 3 wherein said cable securing means comprises said cam having a hole therethrough and said hook apparatus having a spring driven pin mounted through one of the sides with the pin having a manually retractable spring driven extension mounted through a mating hole in one side of the U-shaped opening and extending into the space between the openings, the extension being sized to fit through the hole in the cam, with the length of the extension, the location of the hole through the cam and the location of the pin being such that when the cam is rotated to the first position the pin extension will be driven through the hole in the cam by the pin spring and secure the cam in place, the pin having a knob on the outer end for manually retracting the extension to release the cam.

5. Apparatus as in claim 4 having guard means for protection positioned over said pin.

6. Truss hook apparatus comprising:

a) a hook having an essentially U-shaped opening, the hook also having a slot through one of the sides of the opening oriented essentially perpendicular to both the opening and the side, the opening being sized to admit the cross-section of a truss;

b) the hook having a rotatably mounted cam, the cam being located within the opening and aligned therewith, the cam having an inner edge facing the slot, the cam being sized to permit the inner edge to rotate outwardly through the slot in a first position, and to extend into the opening an adequate amount to grip a truss located therewithin in a second position, the apparatus having a spring attached between the cam and one of the sides of the opening arranged to urge the cam from the first to the second position; and c) a release cable opposing said spring arranged to pivot said cam such as to withdraw the cam from the second to the first position and release a truss located within said hook opening; and d) having a suspension cable for transporting the hook attached to the hook at a location essentially opposite to the opening but offset therefrom an amount adequate to provide full access to the opening for the cross-section of a truss.

* * * * *